US005087234A

United States Patent [19]

Prader et al.

[11] Patent Number: 5,087,234

[45] Date of Patent: Feb. 11, 1992

[54] METHOD OF FORMING AN EASY-OPEN BAG PACK

[75] Inventors: Randolph D. Prader, Fairport; Graham Smith, Walworth, both of N.Y.

[73] Assignee: Mobil Oil Corporation, Fairfax, Va.

[21] Appl. No.: 495,070

[22] Filed: Mar. 19, 1990

[51] Int. Cl.[5] ..... B31B 23/86; B31B 27/60

[52] U.S. Cl. ..... 493/194; 493/204; 493/926

[58] Field of Search ..... 493/194, 195, 196, 204, 493/926

[56] References Cited

U.S. PATENT DOCUMENTS

| | | | |
|---|---|---|---|
| 3,690,221 | 9/1972 | Schmedding | 493/218 |
| 4,106,734 | 8/1978 | Walitalo | 53/390 |
| 4,676,378 | 6/1987 | Baxley et al. | 53/390 |
| 4,704,101 | 11/1987 | Schirmer | 493/195 |
| 4,883,450 | 11/1989 | Benoit | 493/204 |

*Primary Examiner*—William E. Terrell
*Attorney, Agent, or Firm*—A. J. McKillop; C. J. Speciale; J. P. O'Sullivan, Sr.

[57] ABSTRACT

A system for suspending a pack of thermoplastic bags, loading bags, removing loaded bags and for automatically opening the next bag preparatory to loading it by having a pack of handled bags suspended from laterally spaced elongated rods of a rack. The bags have been corona discharge treated in the handle and bag mouth region to such an extent that the pressure and cutting action during the formation thereof will cause adjacently facing cut edge regions to releasably adhere together until a moderate force separates them. During removal of a bag from the bag pack at least a portion of the cut edge of the mouth and handle region of the front wall of the next bag will follow the bag being removed for a short distance before separation thereby opening the next bag rendering it ready for loading.

5 Claims, 2 Drawing Sheets

METHOD OF FORMING AN EASY-OPEN BAG PACK

The present invention is concerned with a pack of bags of the thermoplastic film type wherein each bag is in the layflat condition and is easy to open. It is also concerned with a method of forming the bags and bag packs and a system utilizing the bag packs.

There are many advantages connected with present-day plastic grocery bags, including: they are unaffected by water, they are not as bulky as paper grocery bags, they are less expensive than paper bags, they are stronger, they have handles, etc.

In some dispensing systems, i.e., the bag pack used in conjunction with a suspension and dispensing means, the use of plastic bags will always outperform paper grocery bags from an ease-of-handling and time standpoint. There is, however, always room for improvement, and any innovation which will cut down handling time and/or in any way facilitate the use of such bags amounts to a significant advance in the art.

U.S. Pat. No. 4,676,378, Baxley et al, discloses a technique for suspending a pack of bags from the handles of the bags in the bag pack. The suspension points are located intermediate the top and the bottom of the handles. This is accomplished by threading each stack of handles onto anchored spaced parallel suspension rods through a suspension orifice in each handle. This means or manner of suspension permits individual bags to be opened with one swipe of the hand, leaving the bag in its opened condition, i.e., front panel separated from the back panel, with the handle loops spread open and suspended from the suspension rods. This broad means will be the suspension means involved in the instant invention.

The Baxley et al patent also discloses a technique for automatically opening the next bag in a suspended bag pack as a loaded bag is removed from the system. This is essentially the same technique as is disclosed in U.S. Pat. No. 4,106,734, Walitalo, which teaches suspending handleless bags from suspension rods and utilizing an adhesive area just below the bag mouth on the front of each bag in the pack. This arrangement causes the next adjacent bag in the pack to be in separable adhesive contact with the bag that precedes it. Thus, after a bag is loaded and during removal of the loaded bag from the rack, the front panel of the following bag will tend to follow along a short distance before release. This action causes each following bag to more or less automatically open as a filled bag is removed.

While this technique of enhancing the system of suspending, dispensing and filling grocery sacks has considerable merit,.it does have the disadvantage of leaving each bag with a more or less localized forever tacky region on the outside surface of each bag. It also introduces an additional messy step into the manufacturing process.

It would be a further significant advance in the art if the above-recited result could be accomplished without the mentioned disadvantage.

SUMMARY OF THE INVENTION

The present invention is concerned with a thermoplastic film bag pack comprising a plurality of said bags stacked in at least general registration in a layflat condition, each of said bags comprising a bottom, side walls and an open mouth top portion, said open mouth portion comprising handles located at opposite end regions thereof, at least a portion of the external surface of the film of the open mouth and handles region having been subjected to a corona discharge treatment to such an extent that the pressure and cutting action forming said bag mouth and handles will cause adjacently facing corona discharge treated cut-edge regions to releasably adhere together until a moderate force separates them.

The present invention is also concerned with a method of forming a pack of gusseted, polyethylene film, integrally-extended handle bags comprising:

(a) providing a tube of polyethylene film;
(b) while in a flattened condition, corona discharge treating the external surfaces of said tube at least in part of the regions which will become cut edges of said bags;
(c) forming side gussets in said tube;
(d) transverse-sealing said tube at bag-length distances apart to form a series of end-sealed gusseted pillowcases;
(e) separating and stacking a plurality of said pillowcases in at least general registration; and
(f) applying pressure to one end of the stack and severing all the film layers along a line so as to form integrally-extended double-film loop handles and an open mouth region in each bag and simultaneously or sequentially forming handle support orifices in each handle.

The invention also relates to a system for suspending a pack of bags, for loading bags, for removing loaded bags and for automatically opening the next bag preparatory to loading comprising; a pack of bags suspended on a rack, said rack comprising a pair of laterally-spaced, elongated support rods having leading ends; said bag pack comprising a thermoplastic film bag pack comprising a plurality of said bags stacked in at least general registration in a layflat condition, each of said bags comprising a bottom, side walls and an open mouth top portion, said top portion comprising handles at opposite end regions thereof, at least a portion of the external surface of the film of the open mouth and handles region having been subjected to a corona discharge treatment to such an extent that the pressure and cutting action forming said bag mouth and handles will cause adjacently facing corona discharge treated cut-edge regions to releasably adhere together until a moderate force separates them; aligned mounting orifices in association with said handles located between the top and base of said handles, said pack mounted on said support rods through said orifices so that during removal of a bag from the bag pack at least a portion of the cut edge of the mouth and handle region of the front wall of the next bag will follow the bag being removed for a short distance before separation thereby opening said next bag rendering it ready for loading.

DETAILED DESCRIPTION OF THE INVENTION

Figure 1:
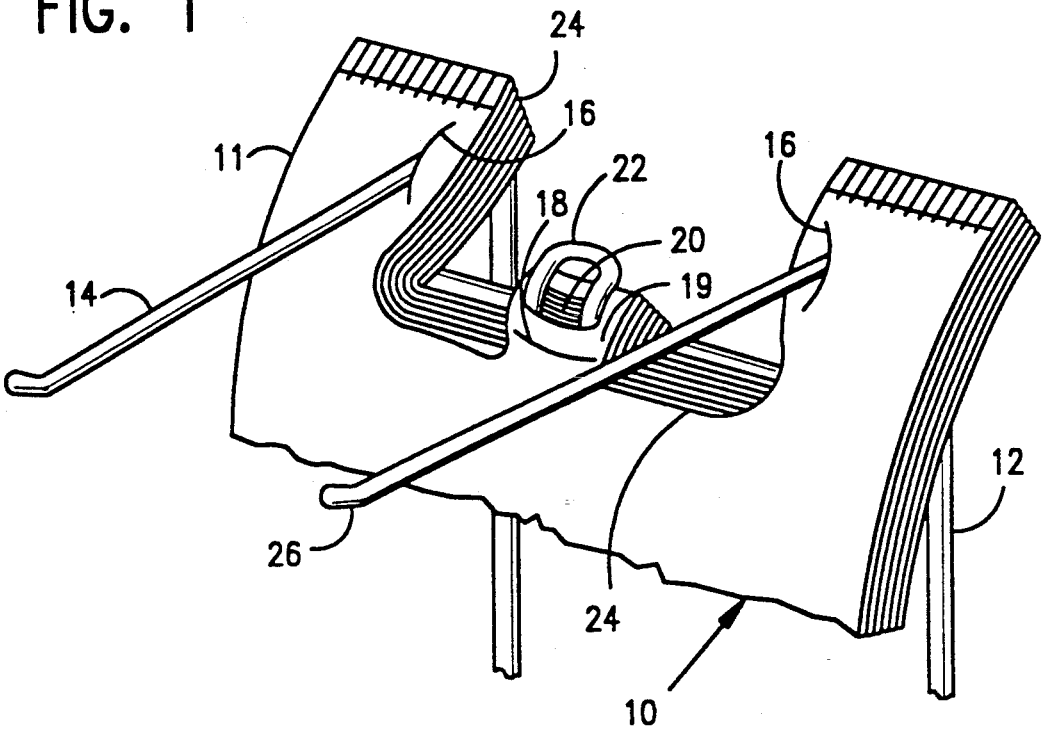
FIG. 1 is a partial perspective view of a bag pack and rack according to the invention.
Figure 2:
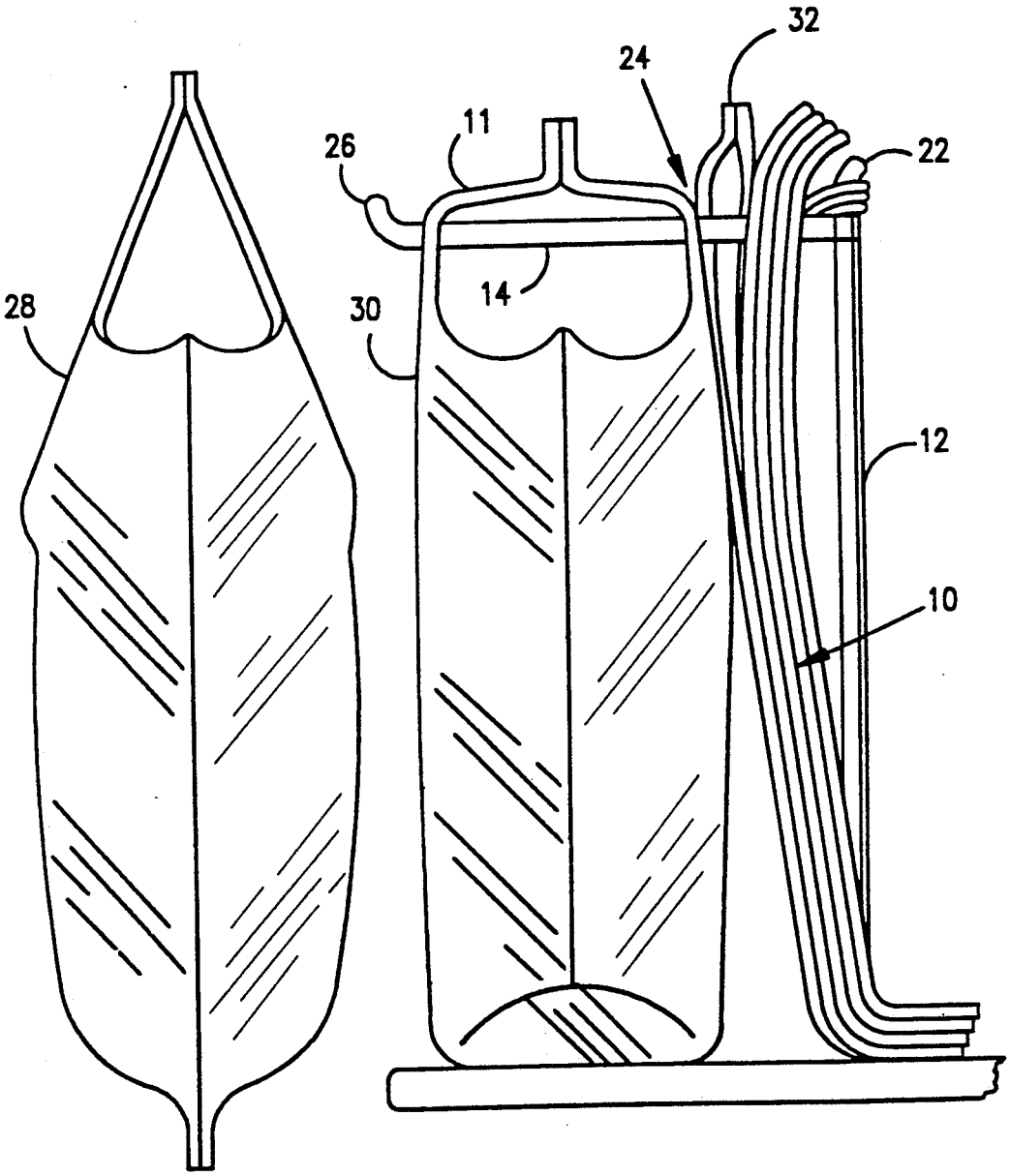
FIG. 2 is a side elevational view of a rack mounted bag pack with several bags shown forwardly drawn therefrom.

In FIG. 1 there is shown a partial segment of a bag pack 10. The lower part of the bag pack is as shown in FIG. 2 and its details are conventional in structure and, thus, form no part of the invention disclosed herein. Pack 10 is shown suspended from rack 12. To accomplish this, the handles 11 are threaded onto parallel arms 14 by way of optionally curved orifices 16.

The individual bags of the bag pack shown have double-film loop handles by virtue of the fact that the bags were made from gusseted pillowcases as is well known in the art. FIG. 2 shows handles 11 of bag 30 almost fully extended on support arms 14. FIG. 1 shows cut line 24, which defines the inboard configuration of the handles, the bag mouth region and a center tab region used for center support of the bag pack. The center tab region includes an orifice 20 utilized for receipt of a suspension member, such as a tongue 22. A separate tab is in association with the front and rear panels of each bag at the mouth region. The front tab has, near the base thereof, a severance line 18 which may be a continuous severance or there may be a small tie connection 19 at each end. In either case, the strength of the material holding the front portion of the bag to the hanger tab area must be small enough to allow the "auto fusion" of the film layers to cause the attached areas to break on the trailing bag. This severance line permits a supermarket bagger to gain easy access to the front panel of the first bag in a pack preparatory to loading the bag. The rear tab is connected by a perforation line to the back panel of each bag.

The essence of the invention is the provision of a system which permits the automatic opening of a following bag during the removal of a loaded bag. This is accomplished by causing at least some part of the upper regions of the outside surfaces of each bag to lightly adhere to one another in chain-like fashion. The aggressiveness of the adhesion should only be enough to break any front tab connection to the front wall of the following bag and cause the upper portion of the front wall to follow the upper portion of the back wall of the bag being removed, for a short distance, such as that shown in FIG. 2.

This phenomenon is accomplished by pretreating the external surfaces of the flattened tubular bag stock polyethylene film material with corona discharge and coupling this with the pressure involved during formation of the handles, bag mouth and center tab of the bag pack. When the corona discharge treatment region at least involves the upper region of what will become the top front and back of the bag, plus the aforementioned pressure, the automatic bag opening will result during use of the packs according to the present system.

The strength of the adhesion between the treated and pressured regions is comparatively small. Yet, small as it is, it is strong enough to break any properly designed tab ties 19 located at the ends of severance line 18. For example, with about 0.45–0.75 mil films, tab ties of up to 3/16 inch are easily broken. Thus, the force necessary to break the adhesion is also comparatively small. This force is supplied by the drag caused by the full weight of the entire following bag, by the drag of the handle film material against the support rod material and/or by the resistance caused by the turned-up ends 26 of the support rods 14. As shown in FIG. 2, bag 28 has separated from bag 30 by reason of one or all of these causes and bag 32 remains adhered to bag 30 but is in the early stage of opening.

Figure 3:
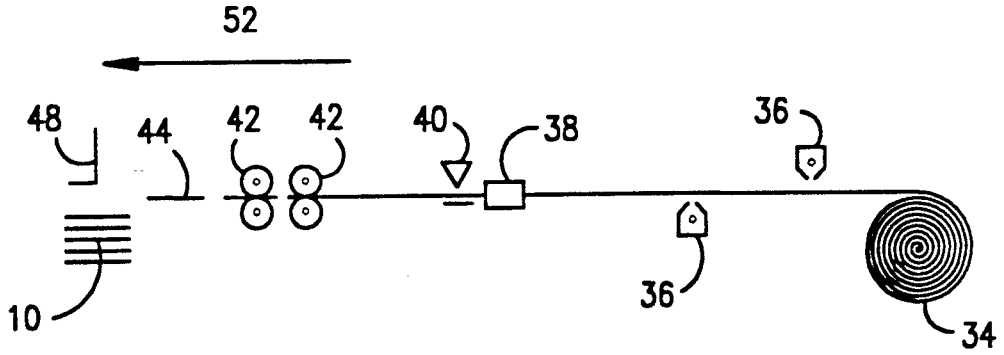
FIG. 3 is a side view of a schematic representation of the method of forming bag packs of the invention.

FIG. 3 illustrates schematically the formation of the treated bag packs. A convoluted roll 34 of a flattened tubular film is the precursor for the individual bags. This film material can be any thermoplastic material which can be treated with corona discharge to so as to be utilizable in the system of the present invention. A suitable class of materials are the polyethylenes generically, including homopolymer polyethylene of high, intermediate or low density, linear low density copolymers of ethylene and another $C_3$–$C_{10}$ alpha-olefin (LLDPE), and any blends of the foregoing. The thickness of the film is that normally used for grocery bags and may range from about 0.3 to about 1.5 mils or greater. A preferred thickness is from about 0.45 to about 0.75 mils. Any size bag is contemplated but the 1/6 bbl. bag and smaller is preferred.

The film material is passed in the direction of arrow 52 between two oppositely disposed corona discharge treaters 36 positioned so as to treat the outside surfaces of the collapsed tube. The treatment can be intermittent so as to treat a designated region or regions of the film or it may be a continuous treatment affecting all of the outside of the bag or that of a narrower stripe restricted to, e.g., the center region of the bag. Corona discharge treatment equipment is readily available commercially. Appropriate equipment can be obtained from Solo Systems Inc., Garland, Tex.; Corotec Corp., Collinsville, Conn.; and others. The film should be treated to a surface tension level of between about 40 to about 55 dynes/cm in accordance with ASTM Standard D2578-84. Using Solo Systems equipment, each treater can have an air gap of 0.060 inch when treating LLDPE film of about 0.65 mils. The treatment area can include a center region of the film 10 inches wide. The film can be treated to 42–44 dynes/cm.

After this degree of treatment, the tube is passed through a gusseter 38 which includes a gusset of from about 3 to about 5 inches into the collapsed tube. The tube proceeds to a transverse heat seal means 40 of conventional design which imposes heat seals 50 at bag length distances apart. Such a heat seal means is usually a resistance strip or bar, positioned to put a transverse seal across the gusseted tube at bag length distances apart. The sealed tube then proceeds to a combination of differential speed rollers which separates the tube into end-sealed gusseted pillowcases 44. The pillowcases are then stacked to the appropriate number desired, e.g., 75, 100, 125, etc., and, either in line or at a remote location, a cutting device 48 applies pressure and cuts one end of the stack so as to remove plastic, leaving the shape of handles, a bag mouth and center suspension tabs in the bag pack. This cutting device 48 may also include means for including a suspension orifice in the handles of the bags. The orifice can be of a variety of shapes, e.g., a circle, part of a circle with a flap remaining therein, a curve of less than one-quarter of a circle, a straight slit, a teardrop cutout, a zig-zag orifice, etc. As shown in FIG. 1, handle suspension orifice 16 is a curved slit facing inward of the handles so that any tendency to tear will propagate toward the inner edge of the handles rather than to the center thereof where it would weaken the handles.

It will be noted that the suspension orifices are located at a midway position in the handles. This is critically important for the most efficient operation of the system of the present invention. Located midway permits the loop of the handles to spread open on suspension rods 14 as shown in FIG. 2. Spreading the handle loops in this manner opens the bag. If the bags were suspended from the handles from a point above the top seals of the handles, as taught by some prior art, the handle loops would not be able to spread open because the support rods would be remote from the loops. Seconds and fractions of a second are extremely important when translated into the front end overhead costs of a supermarket. Any improvement which saves these short intervals of overhead expense is a significant advance in the art. The overall time saved by the present invention is considerable.

Figure 4:
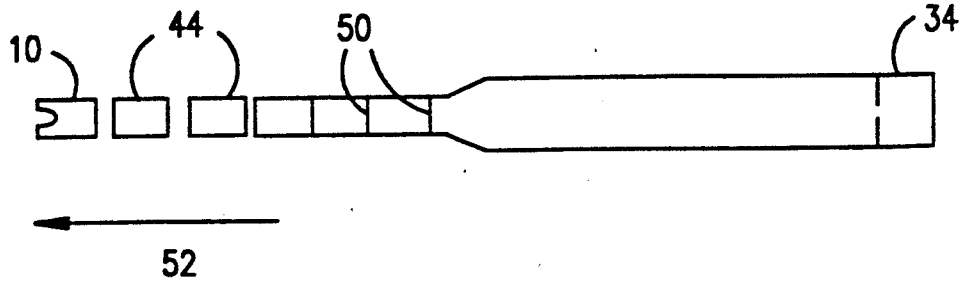
FIG. 4 is a plan view of the schematic of FIG. 3 absent the manipulative means.

FIG. 4 shows in plan view the operation and results of carrying out the process of FIG. 3 which culminates in the formation of bag pack 10.

The pressure necessary to effect the adhesion of the treated surfaces is supplied during the process step of cut forming the handles, bag mouth and central tabs. Thus, the mechanism shearing the top end of the sealed pillowcases to form the cutline 24 also squeezes this region of the bags and the treated films to cause them to adhere in chain-like fashion. To quantify this pressure is difficult, but any pressure involved in the formation of the handle in the bag mouth end of the bag is satisfactory for the adhesion involved in this invention.

It is not understood why the corona discharge treatment and pressure technique results in the efficient automatic opening of a following bag in the subject system. Attention is, however, directed to the paper MECHANISM OF CORONA-INDUCED SELF-ADHESION OF POLYETHYLENE FILM by D. K. Owens, Journal of Applied Polymer Science Vol. 19, pp. 265–271 (1975). In this paper it is postulated that the force of adhesion between corona-treated polyethylene films is a hydrogen bond between the hydrogens of enolized keto groups in one sheet of film and carbonyl groups in the other.

Although the present invention has been described with preferred embodiments, it is to be understood that variations and modifications may be resorted to, without departing from the spirit and scope of the invention, as those skilled in the art will understand. Such modifications and variations are considered to be within the purview and scope of the appended claims.

What is claimed is:

1. A method of forming a pack of gusseted, polyethylene film, integrally-extended handle bags comprising:

(a) providing a tube of polyethylene film;

(b) while in a flattened condition, corona discharge treating the external surfaces of said tube at least in part of the regions which will become cut edges of said bags;

(c) forming side gussets in said tube;

(d) transverse-sealing said tube at bag-length distances apart to form a series of end-sealed gusseted pillowcases;

(e) separating and stacking a plurality of said pillowcases in at least general registration; and (f) applying pressure to one end of the stack and severing all the film layers along a line so as to form integrally-extended double-film loop handles and an open mouth region in each bag and simultaneously or sequentially forming handle support orifices in each handle.

2. The method of claim 1 wherein said severing also forms suspension tabs in the bag mouth region.

3. The method of claim 2 wherein the tab in association with the front wall of said bag is connected thereto by an easily severable web or webs of film.

4. The method of claim 3 wherein said suspension orifices are formed about intermediate the top and base of said handles.

5. The method of claim 4 wherein said treatment is to a surface tension of from about 42 to about 44 dynes/cm.

* * * * *